United States Patent [19]

Agneus et al.

[11] 4,142,073

[45] Feb. 27, 1979

[54] TEMPERATURE-STABLE ELECTRET MICROPHONE WITH EMBOSSED, SMALL AREA, ELECTRET

[75] Inventors: Nils-Erik Agnéus, Karlskrona; Hans-Eric Månsson, Nättraby, both of Sweden

[73] Assignee: Telefonaktiebolaget L M Ericsson, Stockholm, Sweden

[21] Appl. No.: 883,693

[22] Filed: Mar. 6, 1978

[30] Foreign Application Priority Data

Mar. 23, 1977 [SE] Sweden ..... 7703355

[51] Int. Cl.[2] ..... H04R 19/04

[52] U.S. Cl. ..... 179/111 E

[58] Field of Search ..... 179/111 R, 111 E

[56] References Cited

U.S. PATENT DOCUMENTS

| | | | |
|---|---|---|---|
| Re. 28,420 | 5/1975 | Murphy | 179/111 E |
| 3,328,653 | 6/1967 | Wolf, Jr. | 179/111 R |
| 3,821,490 | 6/1974 | Bobb | 179/111 R |
| 4,063,050 | 12/1977 | Carlson et al. | 179/111 E |
| 4,070,741 | 1/1978 | Djuric | 179/111 E |

FOREIGN PATENT DOCUMENTS

| | | | |
|---|---|---|---|
| 293280 | 3/1971 | U.S.S.R. | 179/111 R |

*Primary Examiner*—George G. Stellar

*Attorney, Agent, or Firm*—Hane, Roberts, Spiecens & Cohen

[57] ABSTRACT

Temperature-stable electret microphone with a metallized plastic film stretched over a polarized plastic film and fastened to an underlying fixed electrode, the polarized plastic film being on at least one side embossed with a relief pattern, having a smaller area than the underlying fixed electrode and being concentrically fixed to this by the metallized plastic film.

1 Claim, 1 Drawing Figure

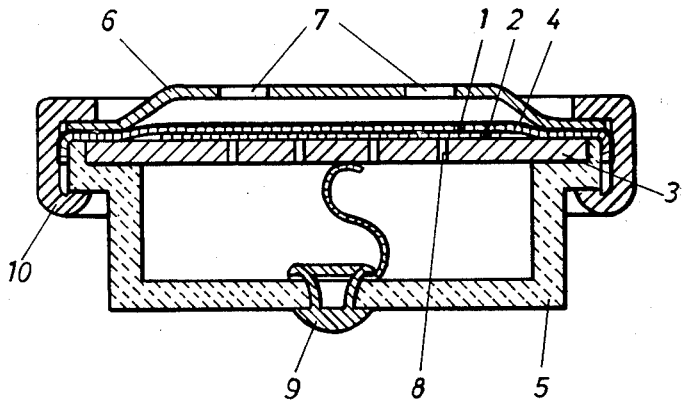
6
7
1
2
4
3
10
9
8
5

TEMPERATURE-STABLE ELECTRET MICROPHONE WITH EMBOSSED, SMALL AREA, ELECTRET

The invention relates to a temperature-stable electret microphone with a metallized plastic film stretched over a polarized plastic film and fastened to an underlying fixed electrode, the polarized plastic film being on at least one side embossed with a relief pattern.

In the Swedish Pat. No. 362,571 an electret microphone of mainly the above-mentioned type is described. Between the plastic films and the fixed electrode microscopical air gaps are formed because of irregularities in their facing surfaces. These microscopical air gaps render the electret microphone a high capacitance and thereby also a high sensitivity. A disadvantage is however that variations in the sensitivity can occur owing to the fact that the air gaps are not sufficiently accurately determined. For example, the tensioning of the plastic films is critical due to the risk that they will extend with ageing. A counter-measure shown in the Swedish Pat. No. 74.10408-4 consists in using a polarized plastic film with a relief pattern embossed on its both sides by a glass web.

With respect to the temperature stability it would be suitable to use materials with the same thermal expansivity in the plastic films and in the fixed electrode in the electret microphone. The material in the polarized plastic film must, however, be selected with regard mainly to obtain as high resistivity as possible which in practice implies a material with a thermal expansitivity considerably larger than the thermal expansitivities of the materials that are suitable for the metallized plastic film and for the fixed electrode. In the electret microphones known through the above-mentioned patent publications there is therefore a risk that heat will make the polarized plastic film wrinkle under the metallized plastic film. Due to the fact that the sensitivity of an electret microphone decreases with the square of the effective diaphragm area, such a wrinkling due to heat can imply a drastic reduction of the output level from the electret microphone.

A main objective of the invention is to provide a temperature-stable electret microphone in which the polarized plastic film will when heated not wrinkle under the metallized plastic film. Further objectives of the invention will appear from the description below.

The invention the characteristics of which appear from the appended claim will now be described more in detail with reference made to the accompanying drawing that is a sectional view of a temperature-stable elctret microphone according to the invention.

The drawing shows a sectional view of an electret microphone with a movable electrode in the form of a first plastic film 1 of Mylar stretched over a second plastic film 2 of Teflon and fastened to an underlying fixed electrode consisting of a metallic base plate 3. The first plastic film 1 is on its upper side provided with a metallic layer 4, while the other plastic film 2 is polarized so as to contain electret charges. The latter is in addition given a relief pattern by having its both sides embossed by a glass web according to a method described in the Swedish Pat. No. 74.10408-4.

The electret microphone has an insulating cover 5 with a metallic lock 6 provided with a number of acoustic openings 7. The metallic base plate 3 is in known manner provided with air channels 8. Acoustic waves are to actuate the two plastic films 1 and 2 through the accoustic windows 7 so that they oscillate in cascade and cause a signal voltage that can be tapped between an electrical connection 9 to the metallic base plate 3 and another electrical connection 10 to the metallic surface layer 4 on the plastic film 1. The electrical connection 9 is made in the form of a spring resting against the metallic base plate 3 while the electrical connection 10 is arranged to fasten the lock 6 to the cover 5 as well as to fasten the plastic film 1 to the base plate 3.

With respect to the temperature-stability it would be suitable to use materials with low and substantially equal thermal expansitivities in the plastic films 1 and 2 and in the metallized base plate 3. This desire can be fulfilled for the metallized plastic film 1 in which the selected material has a thermal expansitivity of about 17 $\times 10^{-6}/°$ C. but cannot be fulfilled for the polarized plastic film 2 in which the material Teflon is selected primarily with the objective to achieve as high resistivity as possible, about $2 \times 10^{16}$ ohm-meter, and has a thermal sensitivity that is relatively large, about $100 \times 10^{-6}/°$ C.

According to the invention, the problem with the temperature stability of the electret microphone is solved thereby that the polarized and weave pattern embossed plastic film 2 is given a smaller area than the underlying metallic base plate 3 and is concentrically fixed to this by the metallized plastic film 1. The plastic film 2 obtains, as a consequence hereof, a requisite thermal expansion space to eliminate the risk that heat will make it wrinkle under the metallized film 1 because of its larger thermal expansivity.

The invention is based on the experience that the weave pattern embossed in the plastic film 2 provides an accurately determined air gap in the electret microphone without a need of any such separate tensioning of the plastic film 2 over the base plate 3 that is described in the above-mentioned Swedish Pat. No. 74.10408-4. The reduced area of the plastic film 2 does not need to imply more than a slight reduction of the effective diaphragm area and has in other respects not been noted to bring with it any disadvantage. Besides the improved temperature stability, a cost reduction is obtained due to less material consumption and a possibility of a prolonged working life of the electret microphone thanks to the fact that the plastic film 2 becomes, as it appears from the drawing, well incapsulated by the metallized plastic film 1, whereby it is prevented that humidity enters and provides the electret charges with a discharge resistance between the opposite sides of the plastic film 2.

We claim:

1. Temperature-stable electret microphone with a metallized plastic film stretched over a polarized plastic film and fastened to an underlying fixed electrode, the polarized plastic film being on at least one side embossed with a relief pattern, having a smaller area than the underlying fixed electrode and being concentrically fixed to this by the metallized plastic film.

* * * * *